United States Patent [19]

Chen et al.

[11] Patent Number: 4,681,321

[45] Date of Patent: Jul. 21, 1987

[54] GOLF CLUB HEAD

[76] Inventors: Chin-Chi Chen, 92,Tung HsingRd., Tung Hsing Tsun, Tali; Yung-Shing Lin, 4,Lane485, Sec.2, Chung Shan Rd., Tan Tzu, both of Taichung Hsian, Taiwan

[21] Appl. No.: 823,753

[22] Filed: Jan. 29, 1986

[51] Int. Cl.[4] ..... A63B 53/04

[52] U.S. Cl. ..... 273/167 H; 273/169; 273/DIG. 23; 273/DIG. 7; 273/167 J

[58] Field of Search ..... 273/167 H, 169, DIG. 7, 273/DIG. 23, 170, 171, 172, 173, 174, 167 J

[56] References Cited

U.S. PATENT DOCUMENTS 4,535,990 8/1985 Yamada ..... 273/167 H X
4,602,787 7/1986 Sugioka et al. ..... 273/167 H
4,624,460 11/1986 Murase et al. ..... 273/169 X

FOREIGN PATENT DOCUMENTS 398643 9/1933 United Kingdom ..... 273/169
664438 1/1952 United Kingdom ..... 273/169

*Primary Examiner*—George J. Marlo
*Attorney, Agent, or Firm*—Cushman, Darby & Cushman

[57] ABSTRACT

A golf club head is provided, having an inner body formed of composite material and an outer body formed of a composite material secured to the outer surface of the inner body and accommodating the inner body. The inner body is hollow, and includes a plurality of rib plates therein to form a force bridge system, each rib plate extending from the inner surface of the inner body adjacent to the hitting surface of the outer body and radially to the surface opposite to the hitting surface.

4 Claims, 5 Drawing Figures

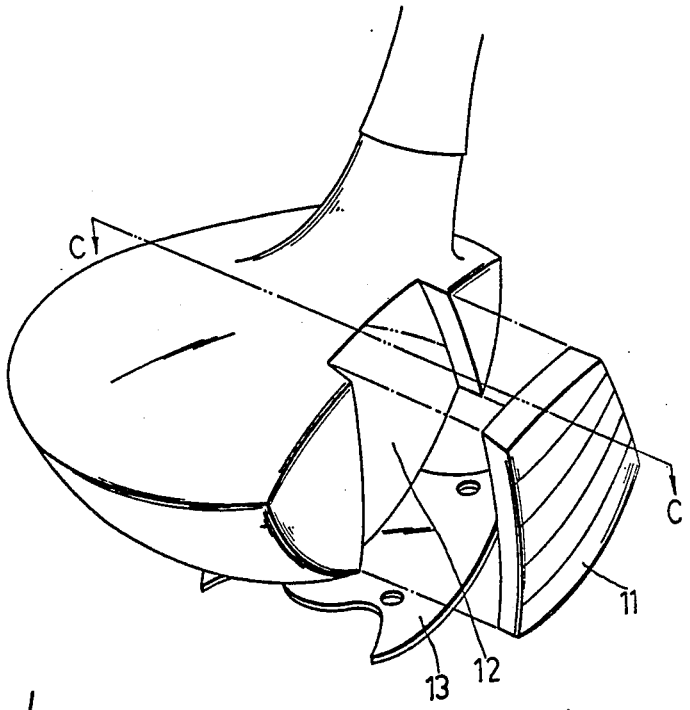
FIG. 1
PRIOR ART
FIG. 2
PRIOR ART
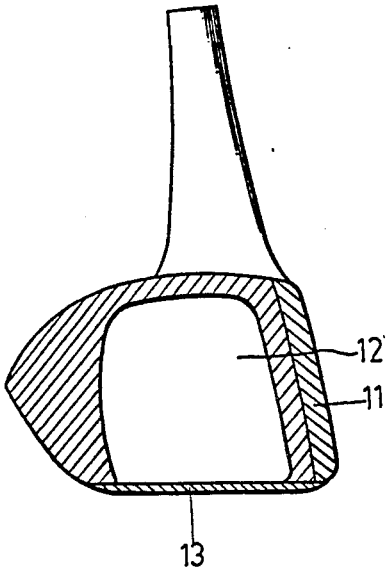

FIG. 3
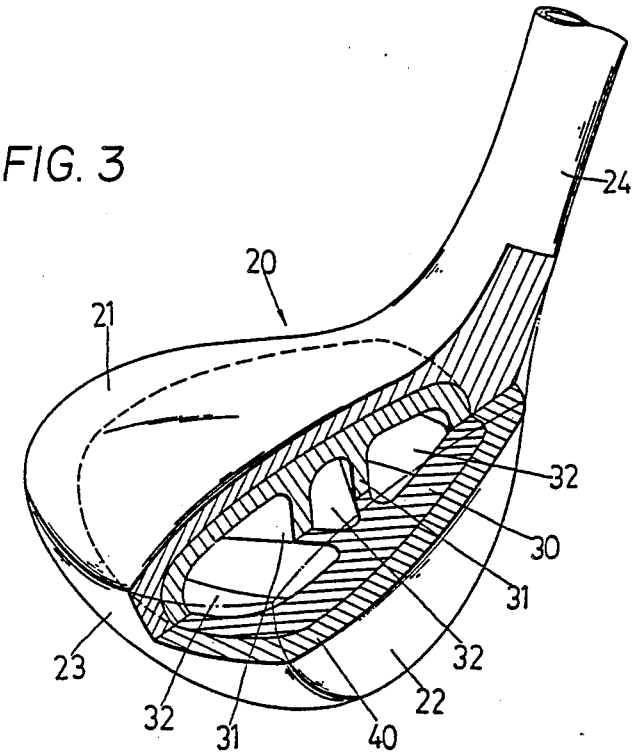
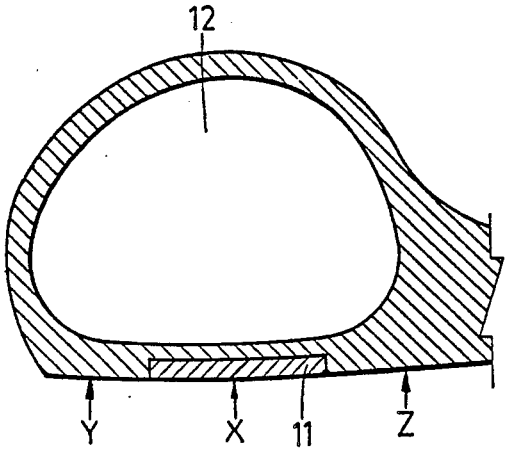
FIG. 4 (a)
PRIOR ART
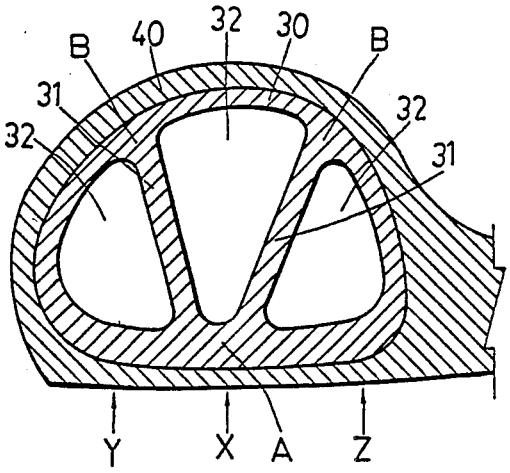
FIG. 4 (b)

GOLF CLUB HEAD

BACKGROUND OF THE INVENTION

The present invention relates to an improved structure of a golf club head, and more particularly to a golf club head which can transfer the percussion force from the hitting point quickly and evenly to the other portions of the golf club head to absorb the vibration when the golf club head hits a golf ball. Therefore, the golfer can more easily control the flying direction of the golf ball.

Conventionally, a golf club head is made of wood of a high degree of hardness, or metal. The wooden club head is easily affected by moisture and therefore it needs complicated maintenance. The metallic club head must be made a small size due to its weight because of the physical property of the material. Although the wooden club head has a better toughness and resilience, its degree of hardness is less. Moreover, if its grain is not oriented well, the club neck will be subjected to large torque and shear forces under the instaneous percussion force of thousands of kilograms when the club hits the ball. This causes deviation of the flying direction of the ball, and even causes the club to be broken. Although the metallic club has a better hardness, it is brittle, easily split, and has less toughness and resilience. When the metallic club head hits the ball, the vibration cannot be absorbed well, and will transfer to the arm of the golfer. This makes the golfer uncomfortable and affects the control of the flying direction of the golf ball.

For solving the above drawbacks, composite materials, such as carbon fiber, have been recently been utilized to improve the structure of the club head. For example, a reinforced layer of composite material interposed between each two adjacent thin wood plates to increase its strength has been developed. However, the surfaces of the wood plates must be provided with a plurality of teeth and grooves to firmly engage with the composite material. Such a structure is difficult to be practiced, since if the numbers of the teeth and grooves are too little, the securing is not firm, while if the numbers are too many, the wood fiber will be destroyed, resulting in less strength.

Furthermore, a club head made of carbon fiber mixed with acrylnitrile butadiene styrene (ABS) by an injection molding process has been developed, as shown in FIG. 1. Its material is selected chopped fiber to prevent the fiber from blocking the nozzle of the injection molding machine. However, such a material has less strength, therefore, a reinforced hitting plate 11 made of long fiber or resin by a compression molding process is secured to the hitting surface, resulting in an increase in cost. In addition, it is necessary that gaps are not allowed to exist between the club head and the reinforced hitting plate 11, since, if so, the stress concentration phenomenon, which frequently causes the hitting plate 11 to be broken, will occur. Moreover, for saving the amount of used material and for faciliating the removal of the die, the club head includes a chamber 12 having an opening at the bottom of the club head, and a protecting plate 13 secured to the bottom and covering the opening. Obviously, the transfer of the action force is terminated at the opening of the chamber 12, whereby the force cannot be transferred to the other portions of the club head quickly. Therefore, vibration cannot be absorbed adequately, and the flying direction of the ball cannot be controlled properly.

SUMMARY OF THE INVENTION

The primary object of the present invention is to provide a golf club head with an improved structure which fully achieves the good physical properties of the composite material, such as high degree of hardness, high toughness, and good resilience.

Another object of the present invention is to provide a golf club head which can facilitate the transferring of the percussion force exerted on the hitting portion to the other portions of the club head quickly via a particular force bridge structure, resulting in a significant decrease in the bad effect caused by the vibration.

Yet another object of the present invention is to provide a golf club head which avoids the use of a reinforced hitting plate, and simplifies the manufacturing process significantly.

In accordance with the present invention, there is provided a golf club head comprising an inner body formed by composite material and an outer body formed of composite material secured to the outer surface of the inner body and accommodating the inner body therein, characterized by that the inner body is hollow, and includes a plurality of rib plates therein to form a force bridge system, each rib plate extending from the inner surface of the inner body radially to the surface opposite to the hitting surface.

BRIEF DESCRIPTION OF THE DRAWINGS

The present invention will be more fully understood from the following detailed description, taken in connection with the accompanying drawings which form an integral part hereof and in which:

FIG. 1 is an exploded perspective view of a conventional golf club head;

FIG. 2 is an elevatonal view of the golf club head of FIG. 1 in cross-section, taken along the line C—C in FIG. 1;

FIG. 3 is a perspective view of an improved golf club head in accordance with one preferred embodiment of the present invention, with parts moved away to illustrate its internal structure;

FIG. 4*a* is an elevational view of the golf club head of FIG. 1 in cross-section to show the conditions of withstanding the hitting force at several places on the golf club head of FIG. 3; and FIG. 4*b* is an elevational view of the golf club head of FIG. 3 in cross-section to show the conditions of withstanding the hitting force at several places on the golf club head.

DETAILED DESCRIPTION OF THE PREFERRED EMBODIMENT

Referring now to the drawings, it should be noted that like members is designated with like reference numbers. In FIG. 3, there is shown an improved golf club head structure 20 in accordance with one preferred embodiment. The club head 20 includes an arcuate top surface 21, a fan-shaped hitting plane 22 extending downwards from the side of the top surface 21, a rear arcuate surface 23 formed between the top surface 21 and the hitting plane 22, and a neck portion 24 extending upwards from the top surface 21. Since the club head 20 utillizes a plurality of arcuate lines, it reduces the stress concentration significantly.

The club head 20 includes an inner portion 30, and an outer portion 40 secured to the outer surface of the inner portion 30 so that the inner portion 30 is snugly disposed against the inner surface of the outer portion 40. The inner portion 30 is made of a composite material by a compression molding process, and is constructed an upper part and a lower part, adhered together. The adhered upper and lower parts are put into a cylindrical die containing a composite material of a thermoplastic epoxy resin or an unsaturated resin mixed with a carbon fiber. The inner portion 30 is interposed in the composite material by molding, and the outer portion 40 of the composite material is then solidified and formed around the outer surface of the inner portion 30 under high temperature and pressure conditions so that no gap will exist between the inner and outer portions 30 and 40.

The inner portion 30 is hollow, and includes a plurality of rib plates 31 extending radially from the inner surface A thereof adjacent to the hitting plane 22 to the inner surface B opposite to the hitting plane 22 to form a force bridge system. The rib plates 31 preferably extend from the place in right rear of the central portion of the hitting plane 22, and partition the hollow space of the inner portion 30 into a plurality of closed chambers 32. Each frame surrounding one chamber 32 constructs an individual force bridge, and all of the frames construct the force bridge system, Therefore, regardless of which point on the club head hits the golf ball, the percussion force will be transferred quickly from one force bridge withstanding the hitting force to the other force bridges, so that the vibration caused by the hitting is absorbed swiftly and evenly, and control of the flying direction of the ball is achieved easily. It should be understood that although the number of the rib plates 31 is two as shown in FIGS. 3 and 4*b*, three or more rib plates can be formed as desired, without deviating from the spirit and scope of the present invention.

With reference to FIGS. 4*a* and 4*b*, there is shown the different transferring manners of percussion force caused by hitting the ball at three points between the conventional club head and the club head of the present invention. When the prior art club head hits the ball at the central portion X, or at the other portions Y and Z thereof, the percussion force only transfers to the other portions rightwards, leftwards and upwards as shown in FIG. 4*a*. Its transferring path is long, resulting in the transferring speed being too low. Therefore, the vibration cannot be absorbed adequately, and proper control of the flying direction of the ball cannot be achieved excellently. In addition, the vibration makes the golfer feel uncomfortable, and the club neck may be broken under the large shear force condition.

However, in spite of which portion, for example the central portion X, the side portion Y or Z, of the club head of the present invention hits the ball, the percusion force can transfer to the nearest force bridge and then to the other force bridges therefrom swiftly. Obviously, its transferring path is much shorter than in the prior art, resulting in that the transferring speed is much higher than in the golf club head of the prior art. Therefore, the vibration-absorbing effect of the club head of the present invention is good.

While the invention has been described in connection with what is presently considered to be the most practical and preferred embodiment, it is to be understood that the invention is not to be limited to the disclosed embodiment but on the contrary, is intended to cover various modifications and equivalent arrangements included within the spirit and scope of the appended claims, which scope is to be accorded the broadest interpretation so as to encompass all such modification and equivalent structures.

What is claimed is:

1. In a golf club head having a neck portion by which the golf club head may be attached to a shaft for use as a golf club, and in which the golf club head includes a molded synthetic plastic resin outer body member having an upwardly convexly arcuate top wall, a fan-shaped, generally flat, front hitting plane wall, a rearwardly convex arcuate rear wall and a generally flat bottom plate, all merging into one another at respective margins, with the neck extending upwards from the top wall near one end of the front hitting plane wall, the improvement wherein:

said golf club head comprises a hollow inner body having an outer surface, and said outer body member completely envelops said inner body and is intimately in contact with said outer surface throughout substantially all of said inner body; and said inner body further includes at least two generally vertical internal partition walls which integrally extend from said bottom plate to said top wall and from said front hitting plane wall to said rear wall and divide said inner body, internally thereof into at least three separate compartments, with said partition walls being disposed to perform, in use, as respective force bridges.

2. The improved golf club head of claim 1, wherein: said internal partition walls diverge from one another from generally centrally of said front hitting plane wall towards said rear wall.

3. The improved golf club head of claim 1, wherein: both said inner body and said outer body are made of like synthetic plastic resin having a filling of carbon fiber.

4. The improved golf club head of claim 1, wherein: both said inner body and said outer body are made of like synthetic plastic resin having a filling of glass fiber.

* * * * *